US010504315B2

(12) United States Patent
Dunn et al.

(10) Patent No.: US 10,504,315 B2
(45) Date of Patent: Dec. 10, 2019

(54) CLAMPING OF MEDIA ITEMS

(71) Applicant: NCR CORPORATION, Duluth, GA (US)

(72) Inventors: Frank B. Dunn, Waterloo (CA); Matthew Sonnenberg, Kitchener (CA)

(73) Assignee: NCR Corporation, Atlanta, GA (US)

( * ) Notice: Subject to any disclaimer, the term of this patent is extended or adjusted under 35 U.S.C. 154(b) by 63 days.

(21) Appl. No.: 13/959,271

(22) Filed: Aug. 5, 2013

(65) Prior Publication Data

US 2015/0034457 A1 Feb. 5, 2015

(51) Int. Cl.

| | |
|---|---|
| ***G07D 11/16*** | (2019.01) |
| ***B65H 31/30*** | (2006.01) |
| ***B65H 3/04*** | (2006.01) |
| ***B65H 5/00*** | (2006.01) |

(52) U.S. Cl.

CPC ..... *G07D 11/16* (2019.01); *B65H 3/047* (2013.01); *B65H 5/006* (2013.01); *B65H 31/3027* (2013.01); *B65H 2301/42262* (2013.01); *B65H 2403/533* (2013.01); *B65H 2404/261* (2013.01); *B65H 2404/2614* (2013.01); *B65H 2408/13* (2013.01); *B65H 2511/224* (2013.01); *B65H 2511/414* (2013.01); *B65H 2515/34* (2013.01); *B65H 2701/1912* (2013.01)

(58) Field of Classification Search

CPC ..... G07D 11/0018; G07D 11/0021; G07D 11/0024; G07D 11/0027; G07D 11/0084; G07D 11/0033; G07D 2207/00; G07D 2211/00; G07D 11/14; G07D 11/16; G07D 11/165; G07D 11/17; G07D 11/18; G07D 11/50; G07F 7/04; G07F 19/20; G07F 19/202; G07F 19/203; B65H 31/3027; B65H 3/047; B65H 5/006; B65H 2701/1912; B65H 2301/42262; B65H 2403/533; B65H 2404/261; B65H 2404/2614; B65H 2408/13; B65H 2515/34; B65H 2511/414; B65H 2511/224

USPC ..... 194/206, 207; 209/534; 235/379; 414/788.5, 788.6; 702/97, 170, 172

See application file for complete search history.

(56) References Cited

U.S. PATENT DOCUMENTS

| | | | | |
|---|---|---|---|---|
| 3,749,395 A | | 7/1973 | Bazzarone et al. | |
| 3,972,157 A | * | 8/1976 | Meyers | B65B 43/26 383/122 |
| 4,320,854 A | * | 3/1982 | Hirose | 221/12 |
| 4,546,857 A | * | 10/1985 | Hamada | E04H 14/00 186/14 |

(Continued)

FOREIGN PATENT DOCUMENTS

| | | |
|---|---|---|
| CN | 1926586 | 3/2007 |
| CN | 102030208 A | 4/2011 |

(Continued)

*Primary Examiner* — Jeffrey A Shapiro

(74) *Attorney, Agent, or Firm* — Schwegman, Lundberg & Woessner

(57) ABSTRACT

The present invention provides a method and apparatus for transporting items of media along a transport path. The apparatus comprises at least one clamp member to apply a clamp force to a bunch of media items located between a support surface and said clamp member, wherein said clamp member is selectively moveable towards or away from said support surface to apply a predetermined clamp force to the bunch of media items.

14 Claims, 8 Drawing Sheets

(56) References Cited

U.S. PATENT DOCUMENTS 4,571,489 A 2/1986 Watanabe
4,616,817 A * 10/1986 Yamauchi et al. ..... 271/111
4,733,765 A * 3/1988 Watanabe ..... 194/206
4,765,607 A * 8/1988 Zouzoulas ..... B65H 29/18 198/575
4,980,543 A * 12/1990 Hara et al. ..... 235/379
5,058,880 A * 10/1991 McGraw et al. ..... 271/315
5,106,077 A * 4/1992 Kawaguchi ..... G07D 11/0018 271/200
6,164,638 A * 12/2000 Owens et al. ..... 271/34
6,173,607 B1 * 1/2001 Shahaf et al. ..... 73/159
7,883,088 B2 * 2/2011 Nutzel et al. ..... 271/258.01
8,167,135 B2 * 5/2012 Nutzel et al. ..... 209/534
8,262,076 B2 * 9/2012 Wilson et al. ..... 271/10.01
9,016,683 B2 4/2015 Sonnenberg
2001/0045697 A1 * 11/2001 Daout ..... B65H 5/062 271/266
2003/0089769 A1 * 5/2003 Jantsch ..... 235/381
2003/0094402 A1 * 5/2003 Seo et al. ..... 209/534
2003/0132568 A1 * 7/2003 Garcia ..... B65H 3/0646 271/38
2006/0067559 A1 * 3/2006 Donders ..... 382/100
2006/0225986 A1 * 10/2006 Oishi ..... B65H 5/28 194/203
2007/0007707 A1 * 1/2007 Abe et al. ..... 271/97
2007/0034683 A1 * 2/2007 Eastman et al. ..... 235/379
2007/0045396 A1 * 3/2007 Kitagawa et al. ..... 235/379
2007/0182090 A1 * 8/2007 Gerlier ..... B65H 29/145 271/180
2007/0267488 A1 * 11/2007 Chang ..... 235/381
2008/0142583 A1 * 6/2008 Yokoi et al. ..... 235/379
2009/0206541 A1 * 8/2009 Nutzel et al. ..... 271/10.01
2010/0025308 A1 * 2/2010 Nutzel et al. ..... 209/534
2010/0042254 A1 * 2/2010 Van Heek ..... B65B 43/185 700/230
2010/0052237 A1 * 3/2010 Herczeg et al. ..... 271/3.16
2010/0125515 A1 * 5/2010 Aso et al. ..... 705/35
2011/0031308 A1 * 2/2011 Holland-Letz ..... B65H 1/025 235/379
2011/0187038 A1 * 8/2011 Heise et al. ..... 271/3.11
2012/0007304 A1 * 1/2012 Wilson et al. ..... 271/10.01
2014/0151272 A1 * 6/2014 Angus et al. ..... 209/3.1
2015/0136562 A1 * 5/2015 Fujita ..... G07D 11/0018 194/206

FOREIGN PATENT DOCUMENTS

CN 104346859 A 2/2015
DE 102008030878 A1 12/2009
EP 1926057 5/2008
GB 2123592 2/1984
JP 2002-329229 11/2002
JP 2011-079596 4/2011
JP 2012-038355 2/2012

* cited by examiner

CLAMPING OF MEDIA ITEMS

FIELD OF THE INVENTION

The present invention relates to a method and apparatus for transporting media items along a transport path. In particular, but not exclusively, the present invention relates to transporting media items, such as currency notes, checks or the like, along a transport path within a media item processing module and clamping the media items with a desired force at a predetermined location on the transport path whilst the media item processing module is in a predetermined mode of operation.

Various situations are known in which media items are transported along a transport pathway in a Self-Service Terminal (SST). For example, in a typical check depositing Automated Teller Machine (ATM), an ATM customer is allowed to deposit a check (without having to place the check in a deposit envelope) in a publicly accessible, unattended environment. To deposit a check, the ATM customer inserts an identification card through a card slot of the ATM, enters the amount of the check being deposited and inserts a check to be deposited through a check slot of a check acceptor. A check transport mechanism receives the inserted check and transports the check in a forward direction along an "infeed" check transport path to a number of locations within the ATM to process the check. Other forms of media item may include currency notes, coupons, vouchers, tokens, or the like, and the media items may include one media item or a number of media items in the form of a bunch of media items.

It is known for a check transport mechanism to include a first transport member and an opposed second transport member facing the first transport member for transporting a bunch of media items located between the first and second transport members along a transport path. It is also known for each of the transport members to include a transport belt to effectively grip and move the bunch of media items along the transport path. A compression force is applied to the bunch of media items by the respective transport belts such that all the media items of the bunch are transported together and slippage of media items located inside the bunch during transportation is controlled.

However, in certain modes of operation of an SST, a compression force applied to a bunch of media items may not be suitable for all other modes of operation, such as when separating a media item from a bunch of media items. This can cause failure during certain operations at the SST.

SUMMARY OF THE INVENTION

It is an aim of the present invention to at least partly mitigate the above-mentioned problems.

It is an aim of certain embodiments of the present invention to provide a method and apparatus for transporting a bunch of media items of media along at least one transport path within an SST.

It is an aim of certain embodiments of the present invention to provide a method and apparatus for removing or adding a media item to a bunch of media items.

It is an aim of certain embodiments of the present invention to provide a method and apparatus for applying a predetermined clamp force to a bunch of media items located between first and second transport members of a media item processing module.

It is an aim of certain embodiments of the present invention to provide a self-adjusting clamping mechanism for applying a predetermined clamp force to a bunch of media items dependent upon a mode of operation of a media item processing module.

According to a first aspect of the present invention there is provided a method of transporting at least one media item along a transport path, comprising:

locating a bunch of media items between at least one support surface and at least one clamp member; and selectively moving said clamp member towards or away from said support surface to apply a predetermined clamp force to the bunch of media items.

Aptly, the method further comprises:

determining a thickness associated with the bunch of media items; and selectively moving said clamp member towards or away from said support surface responsive to the thickness.

Aptly, the method further comprises:

removing or adding a media item from or to the bunch of media items to respectively decrease or increase said thickness of the bunch of media items and moving the clamp member to maintain a pre-determined clamp force as the thickness is decreased or increased.

Aptly, the method further comprises:

determining said thickness of the bunch of media items by sensing a displacement of a moveable element that is moveable towards or away from the clamp member responsive to said thickness of the bunch of media items; and selectively moving the clamp member towards or away from the support surface to apply the predetermined clamp force to the bunch of media items responsive to a displacement of the moveable element.

Aptly, the method further comprises:

biasing said moveable element towards said clamp member.

According to a second aspect of the present invention there is provided apparatus for transporting at least one media item along a transport path, comprising:

at least one clamp member to apply a clamp force to a bunch of media items located between a support surface and said clamp member; wherein said clamp member is selectively moveable towards or away from said support surface to apply a predetermined clamp force to the bunch of media items.

Aptly, the apparatus further comprises:

at least one moveable element moveable towards or away from said clamp member responsive to a thickness associated with the bunch of media items, wherein said clamp member is selectively moved towards or away from said support surface responsive to said thickness.

Aptly, the apparatus further comprises:

at least one sensor to sense a displacement of the moveable element towards or away from the clamp member.

Aptly, the apparatus further comprises:

at least one target element associated with the moveable element;

wherein the at least one sensor comprises an optical displacement sensor that determines a location of said target element responsive to said displacement of the moveable element.

Aptly, the apparatus further comprises:

at least one transport belt for locating the bunch of media items, wherein an outer drive surface of said transport belt further comprises said support surface.

Aptly, said moveable element is biased against an inner surface of said transport belt and is moveable towards or away from said clamp member responsive to a displacement of the transport belt.

Aptly, said moveable element comprises at least one transport belt roller.

Aptly, the apparatus further comprises:

a biasing member that constantly biases the clamp member towards the support surface; and an actuator that selectively locates a portion of the clamp member to at least partially counteract the constant biasing to selectively move the clamp member at least partially away from the support surface.

According to a third aspect of the present invention there is provided a media item processing module comprising apparatus in accordance with the first aspect of the present invention.

According to a fifth aspect of the present invention there is provided a Self-Service Terminal (SST) comprising a media item processing module in accordance with the fourth aspect of the present invention.

According to a fifth aspect of the present invention there is provided a method of locating at least one media item, comprising:

clamping a bunch of media items between a clamp member and a support surface, wherein a clamp force applied by the clamp member in a first mode of operation is greater than a clamp force applied by the clamp member in a further mode of operation when at least one media item is to be removed from or added to the bunch.

Certain embodiments of the present invention provide a method and apparatus for applying a pre-determined clamp force to a bunch of media items being transported along a transport path within an SST responsive to a predetermined mode of operation of the SST.

Certain embodiments of the present invention allow a first clamp force to be applied to a bunch of media items for transporting the bunch along a predetermined transport path whilst allowing a second clamp force to be applied to the bunch for removing or adding a media item from or to the bunch, wherein the second clamp force is less than the first clamp force.

Certain embodiments of the present invention provide a self-adjusting clamping mechanism for automatically applying a predetermined clamp force to a bunch of media items responsive to a predetermined mode of operation of a media item processing module.

Certain embodiments of the present invention provide a self-adjusting clamping mechanism for applying a predetermined clamp force to a bunch of media items responsive to a variable thickness of a bunch of media items to which the clamp force is applied.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
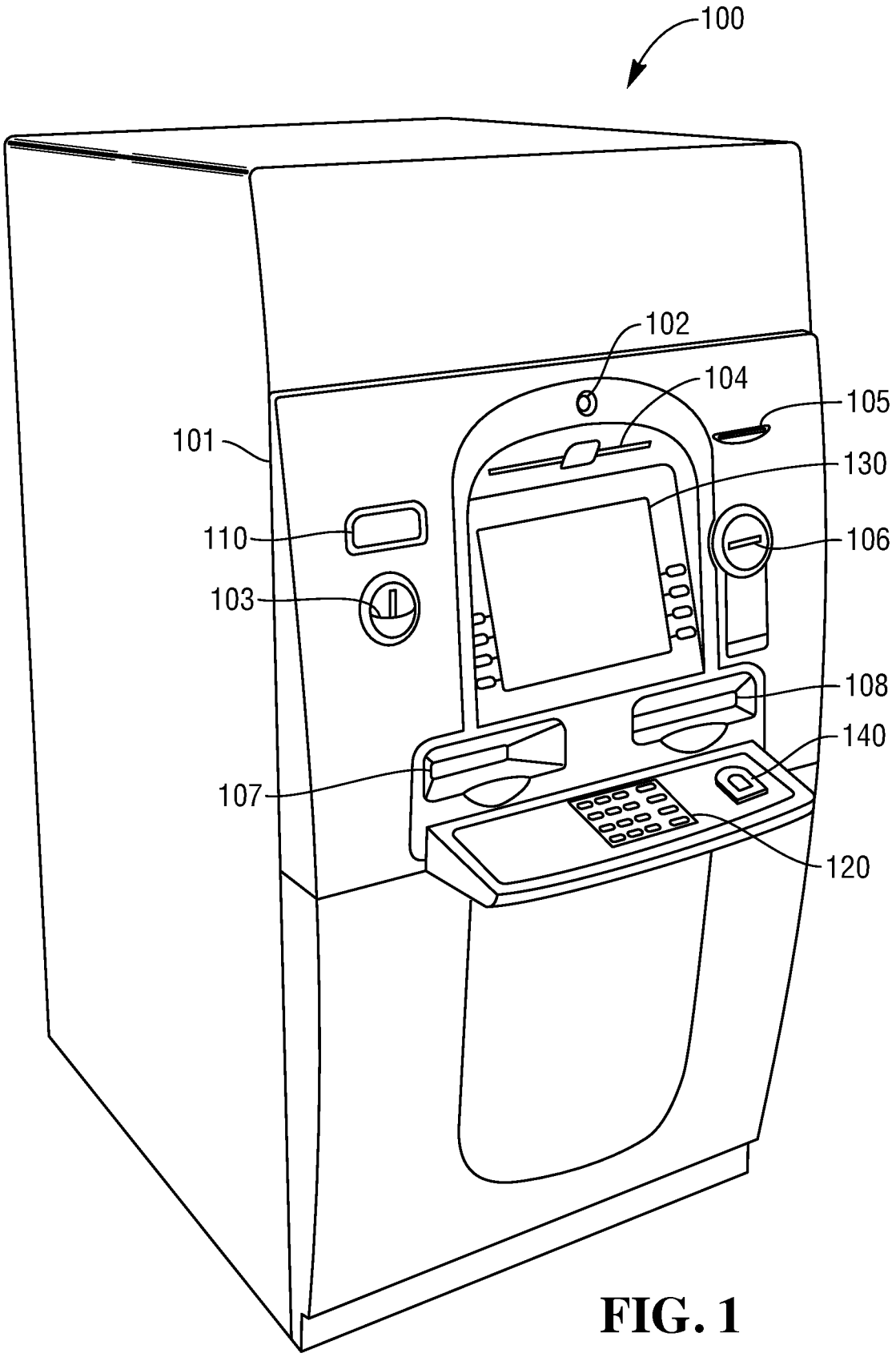
FIG. 1 illustrates an ATM according to an embodiment of the present invention.

In the drawings like reference numerals refer to like parts.

FIG. 1 illustrates a self-service check depositing terminal in the form of an image-based check depositing Automated Teller Machine (ATM) 100. It will be appreciated that certain embodiments of the present invention are applicable to a wide variety of terminals in which items of media such as checks and/or currency notes and/or giros and/or lottery tickets and/or other such flexible sheet-like items of media are to be transported and directed in different directions. The type of terminal will of course be appropriate for the type of items of media being transported.

As illustrated in FIG. 1, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash slot 107, a further cash slot 108 and a check input/output slot 110. The slots and tray are arranged such that the slots and tray align with corresponding ATM modules mounted within the chassis of the ATM.

The fascia 101 provides a customer interface for allowing an ATM customer to execute a transaction. The fascia 101 includes an encrypting keyboard 120 for allowing an ATM customer to enter transaction details. A display 130 is provided for presenting screens to an ATM customer. A fingerprint reader 140 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a customer of the ATM is authorized and/or whether an item of media being transported satisfies certain pre-determined criteria.

Figure 2:
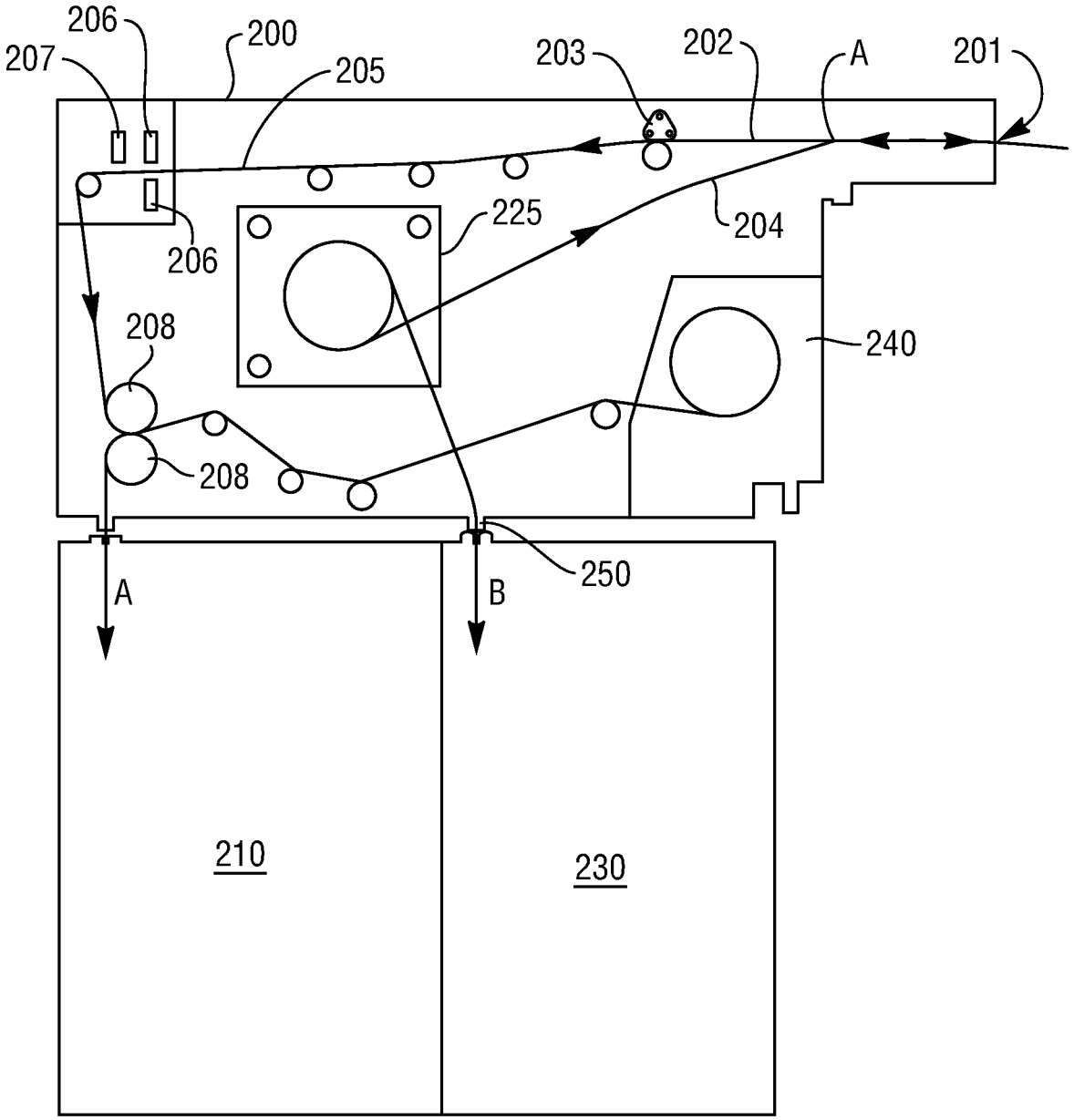
FIG. 2 illustrates transport pathways and modules within the ATM of FIG. 1 according to an embodiment of the present invention.

FIG. 2 illustrates possible transport pathways and internal modules within the ATM which can be utilized to process deposited checks. A check processing module 200 has an access mouth 201 through which incoming checks and/or currency notes are deposited or outgoing checks are dispensed. This mouth 201 is aligned with an infeed aperture in the ATM which thus provides an input/output slot 110. A bunch of one or more media items, such as currency notes or checks, is input or output. Aptly, a bunch of up to a hundred items or more can be received/dispensed. Incoming checks follow a first transport path 202 away from the mouth 201 in a substantially horizontal direction from right to left shown in FIG. 2. The first transport path 202 is also referred to as the infeed path. The checks then pass through a feeder/separator 203 and along another pathway portion 205 which is also substantially horizontal and right to left. The checks are then de-skewed and read by imaging cameras 206 and an MICR reader 207. Checks are then directed substantially vertically downwards to a point between two nip rollers 208. These nip rollers co-operate and are rotated in opposite directions with respect to each other to either draw deposited checks inwards (and urge those checks towards the right hand side in FIG. 2), or during another mode of operation, the rollers can be rotated in an opposite fashion to direct processed checks downwards in the direction shown by arrow A in FIG. 2 into a check bin 210. Incoming checks which are moved by the nip rollers 208 towards the right can either be diverted upwards (in FIG. 2) into a re-buncher unit 225, or downwards in the direction of arrow B in FIG. 2 into a cash bin 230, or to the right hand side shown in FIG. 2 into an escrow 240. Checks from the escrow can be directed to the re-buncher 225 or downwards into the cash bin 230. Checks can be reprocessed or returned to a customer via a further transport path 204, also known as the return path.

Figure 3:
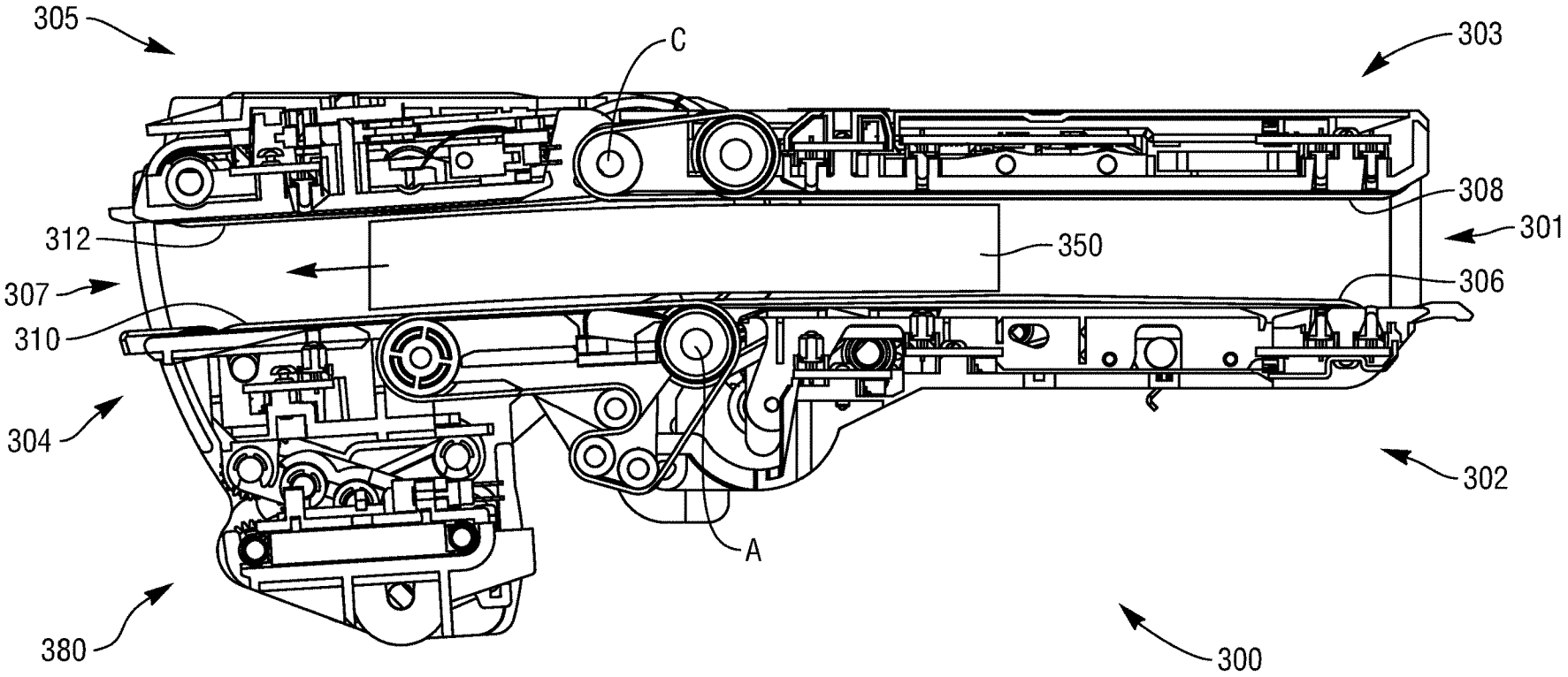
FIG. 3 illustrates a media item transport mechanism according to an embodiment of the present invention wherein the transport mechanism is in an infeed configuration for transporting a bunch of media items along an infeed transport path.

As illustrated in FIG. 3, a media item transport mechanism 300 includes a first pair of opposed transport members 302, 303 shown on the right-hand side of FIG. 3 and a second pair of opposed transport members 304, 305 shown on the left-hand side of FIG. 3. The pairs of transport members provide a predetermined transport path 202, 204 for a bunch of media items 350, such as checks or currency notes, to be urged along by the transport mechanism 300. An infeed end region 301 of the first pair of transport members 302, 303 is located and aligned with the access mouth 201 of the check processing module 200. The second pair of transport members 304, 305 pivots relative to the first pair of transport members 302, 305 generally about axis A to selectively direct the bunch 350 along the infeed path 202 or return path 204 as desired. As shown in FIG. 3, an end region 307 of the second pair of transport members 304, 305 is aligned with the feeder/separator 203 when in the infeed position for single media items to be separated from the bunch 350 and individually processed by the processing module 200.

Each of the transport members 302, 303, 304, 305 includes at least one respective transport belt 306, 308, 310, 312 for urging one or more media items along the transport path 202, 204. Aptly, each transport member may include a pair of spaced apart transport belts. Alternatively or additionally, rollers, gears, wheels, plates, or the like, may be used to urge one or more media items along the transport path 202, 204.

Each pair of transport members 302, 303 and 304, 305 are selectively moved towards or away from each other between closed and open configurations. This is achieved by moving one transport member towards or away from a fixed respective transport member or by moving both respective transport members towards or away from each other. A distance between a respective pair of belts of a respective transport member when in the open configuration is determined by the thickness of a bunch of media items to be or being transported through the transport mechanism 300 and along the transport path 202, 204. For example, respective belts of a pair of transport members will be closer together when gripping and transporting a single media item and spaced further apart from each other when transporting a bunch of media items.

The lower transport member 304 of the second pair of transport members 304, 305 as shown in FIG. 3 is rotatable about axis A with respect to the lower transport member 302 of the first pair of transport members 302, 303. The upper transport member 305 of the second pair of transport members 304, 305 is about axis C with respect to the upper transport member 303 of the first pair of transport members 302, 303. Axes A and C are located at respective end regions of the upper and lower transport members 302, 303 of the first pair of transport members 302, 303. Thus, the lower transport member 304 of the second pair of transport members 304, 305 is rotatable with respect to the lower transport member 302 of the first pair of transport members 302, 303 between an infeed position, wherein media items are moved from right to left (as shown in FIG. 3) through the transport mechanism 300 and along the infeed transport path 202 to be processed, and a return position, wherein media items are moved from left to right through the transport mechanism 300 and along the return transport path 204 to be reprocessed along the infeed path or returned to a customer.

Figure 4:
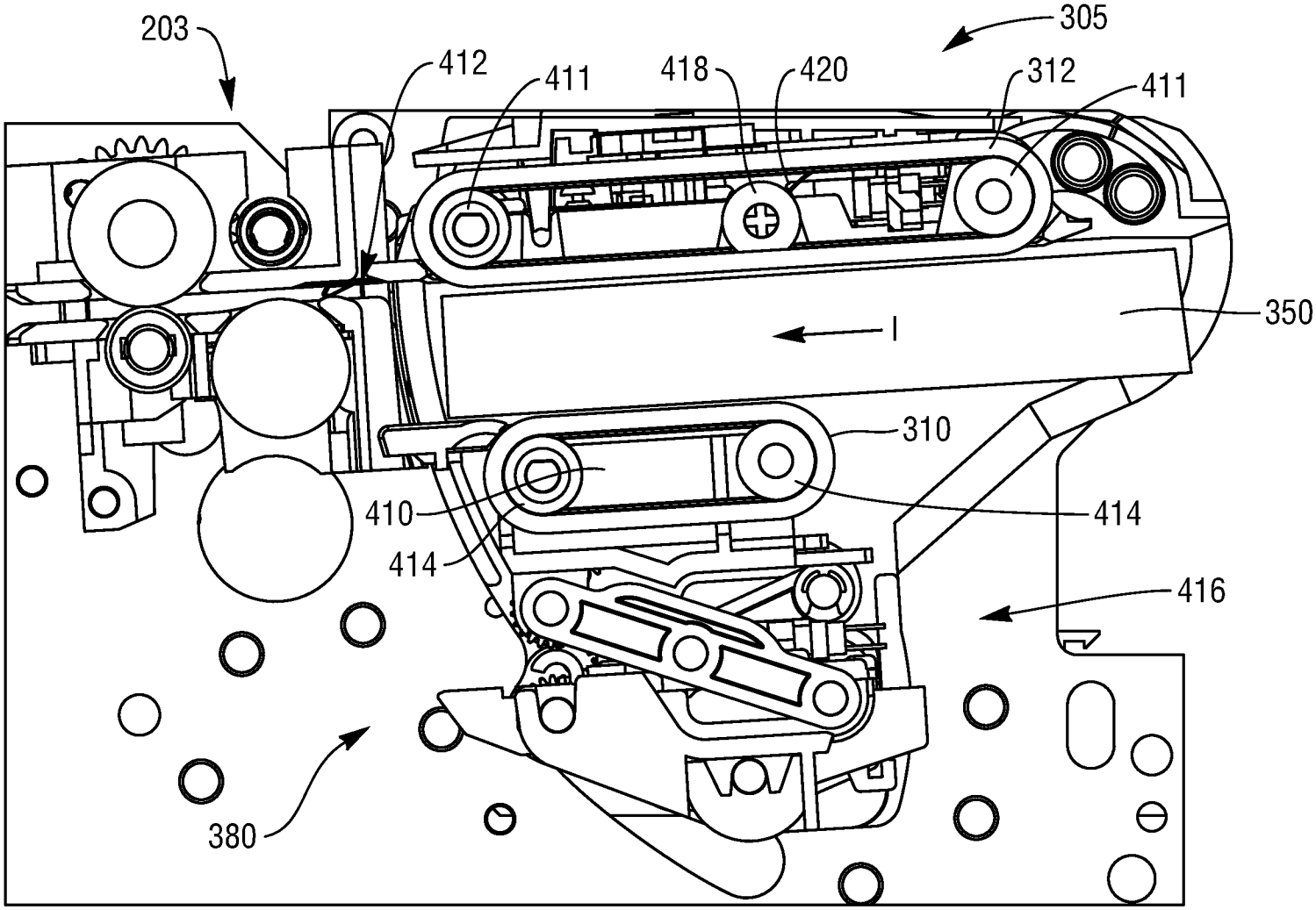
FIG. 4 illustrates a clamping mechanism of the media item transport mechanism of FIG. 3 when in the infeed position and aligned with a media item separator/feeder of the ATM of FIG. 2.

The second pair of transport members 304, 305 includes a clamping mechanism 380 for applying a predetermined clamp force to a bunch of media items 350. The lower transport belt 310 of the lower transport member 304 of the second pair of transport members 304, 305 forms part of a moveable clamp member 410 (as best shown in FIG. 4) of the clamping mechanism 380. The upper transport belt 312 of the upper transport member 305 of the second pair of transport members 304, 305 provides a support surface for engaging the bunch of media items 350 whilst a clamp force is applied to the bunch by the moveable clamp member 410. The clamp member 410 of the clamping mechanism 380 selectively moves towards or away from the upper transport belt 312 to respectively increase or decrease the clamp force applied to the bunch 350 responsive to a predetermined mode of operation of the ATM and/or a thickness of the bunch 350, as will be described below.

As illustrated in FIG. 4, when in the infeed position, an end region of the second pair of transport members 304, 305 is aligned with an infeed opening 412 of the feeder/separator module 203 of the media processing module 200 which removes or adds one or more media items from or to the bunch of media items 350 respectively.

The upper and lower transport belts 312, 310 of the second pair of transport members 304, 305 urge the bunch of media items from right to left along the infeed path 202 (as indicated by arrow I) towards the infeed mouth 412 of the feeder/separator module 203 when the second pair of transport members 304, 305 is in the infeed position, as shown in FIG. 4. Alternatively, when the second pair of transport members 304, 305 is orientated downwardly with respect to the first pair of transport member 303, 304 (not shown in FIG. 4), the upper and lower transport belts 312, 310 urge the bunch of media items 350 from left to right along the return path 204 to return the bunch to a customer or to re-process the bunch.

The upper transport belt 312 of the second pair of transport members 304, 305 is supported by a pair of spaced apart rollers 411, at least one of which is driven to selectively rotate the transport belt 312 in the infeed or return direction. The lower transport belt 310 is supported on a pair of spaced apart rollers 414 of a moveable clamp member 410 of the clamping mechanism 380, wherein at least one roller 414 is driven to selectively rotate the transport belt 310 in the infeed or return direction.

The clamp member 410 (and lower transport belt 310) is selectively moveable towards or away from the upper transport belt 312 of the upper transport member 305 by an actuator mechanism 416 to thereby selectively apply a clamp force to the bunch of media items 350 located between the upper and lower transport belts 312, 310. The upper transport belt 312 acts as a support member against which the bunch 350 abuts when being compressed by the clamp member 410.

In a transport mode of operation, as shown in FIG. 3, wherein the bunch of media items 350 are to be or being transported along a predetermined transport path 202, 204, a predetermined clamp force is applied to the bunch 350 by the clamping mechanism 380 to effectively transport the bunch along the infeed (or return) path 202, 204 without the internals of the bunch shifting. In a separation mode of operation, as shown in FIG. 4, wherein the bunch 350 is being urged towards the opening 412 of the feeder/separator module 203 for a media item to be removed (or added) from the bunch by the feeder/separator module 203, a lower clamping force to that applied in the transport mode of operation is applied to the bunch 350 to allow for effective removal or addition of a media item from the bunch of media items by the feeder/separator module 203.

Figure 5:
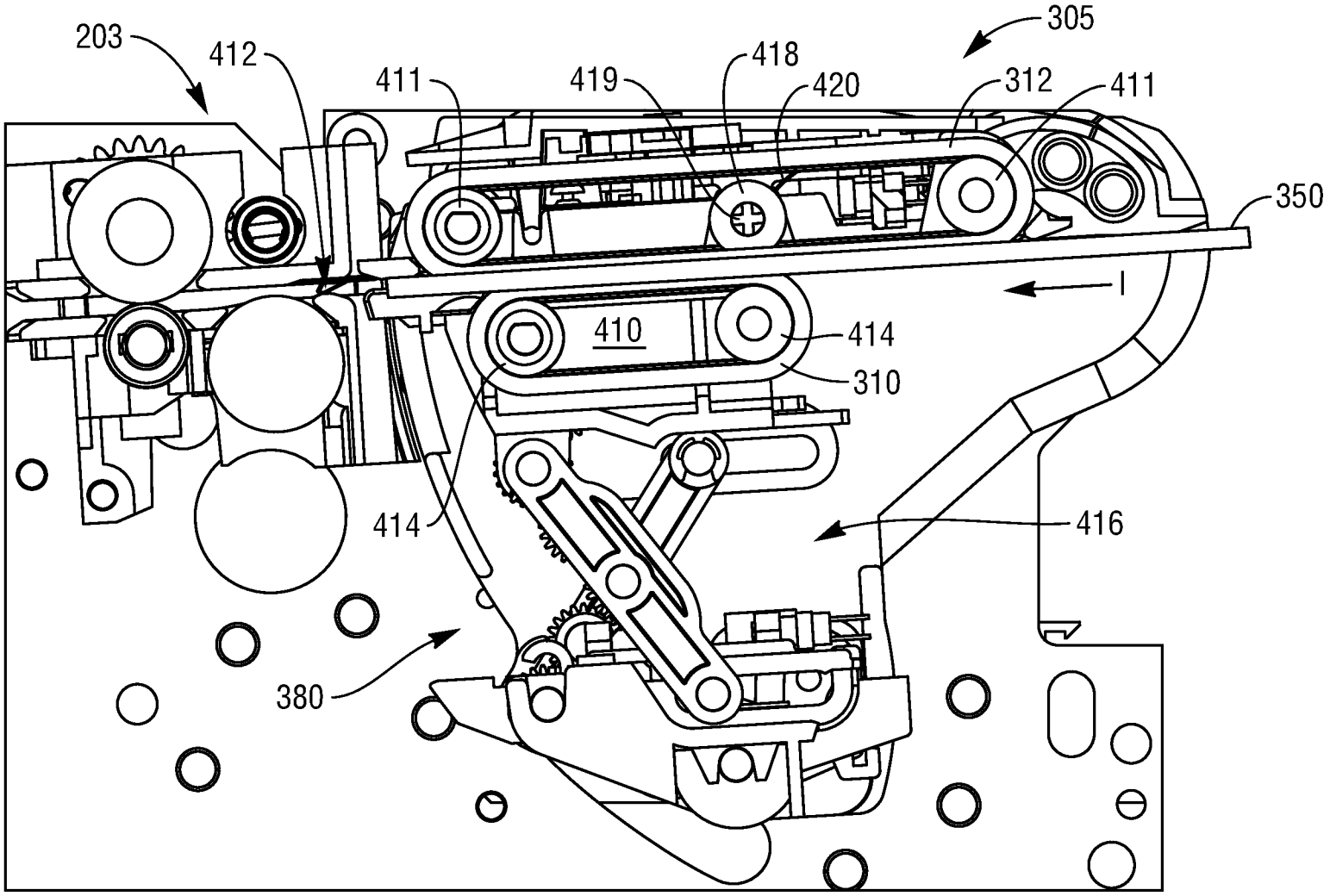
FIG. 5 illustrates the clamping mechanism of FIG. 4 applying a clamping force to a relatively thin bunch of media items.
Figure 6:
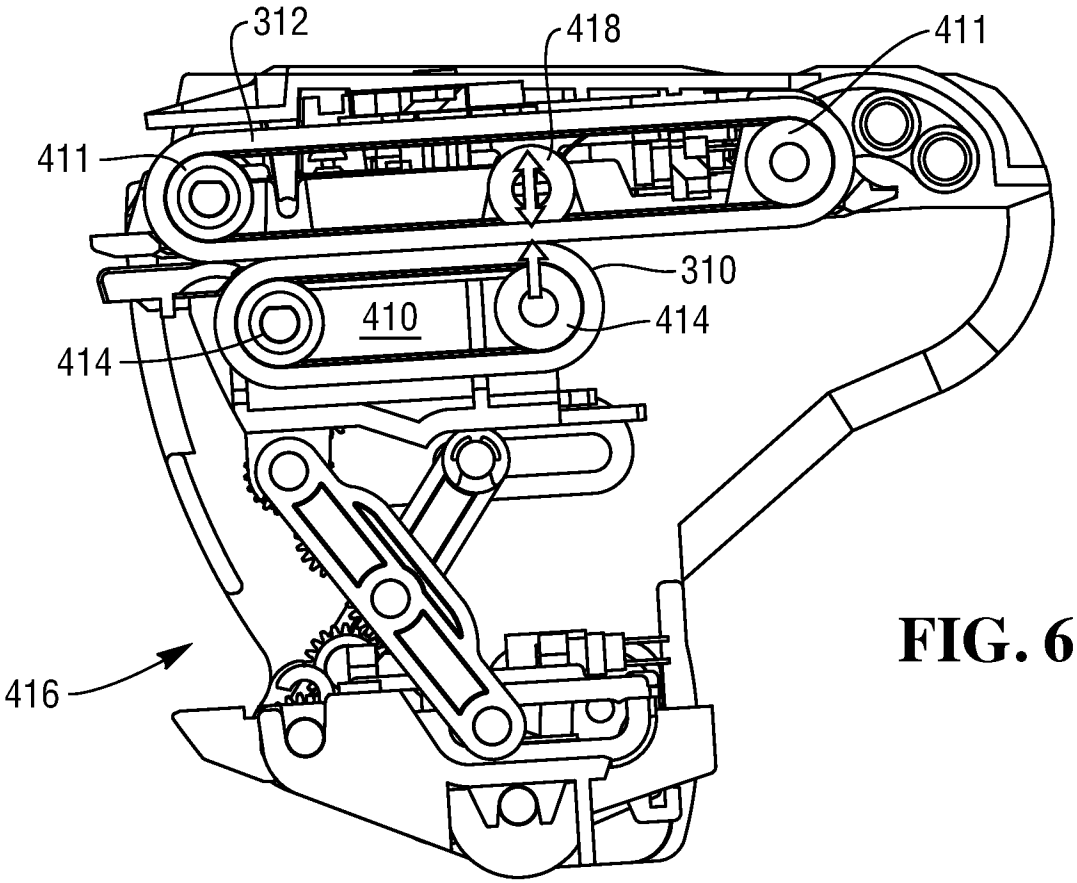
FIG. 6 illustrates further detail of the clamping mechanism of FIGS. 4 and 5.

As shown in FIGS. 4 to 7, an idler roller 418 is located between the spaced part rollers 411 of the upper transport member 305 to engage with the upper transport belt 312. The idler roller 418 is biased by a leaf spring 420 towards the upper transport belt 312 to in turn urge the upper transport belt 312 towards the clamp member 410. When being transported along the infeed path 202, a bunch of media items 350 moves from right to left to be located between the upper and lower transport belts 312, 310 of the second pair of transport members 304, 305. When the bunch 350 is moved to a location proximal to the idler roller 420, the bunch 350 counteracts the force exerted on the upper transport belt 312 by the idler roller 420 and the leaf spring 420 arrangement and forces the idler roller 418 away from clamp member 410. The distance by which the idler roller 420 is moved away from the clamp member 410 by the bunch 350 is dependent on the thickness of the bunch 350. For example, as shown in FIG. 4, a relatively thick bunch of media items 350 will displace the idler roller 420 by a greater amount than a relatively thin bunch of media items 350 as shown in FIG. 5. As media items are removed from a bunch 350 by the feeder/separator module 203, the thickness of the bunch 350 will decrease and the clamp member 410 is required to move towards the upper transport belt 312 to accommodate for this change in thickness in order to apply a predetermined clamping force on the bunch 350. In a similar manner, when media items are added to a bunch 350 by the feeder/separator module 203, the thickness of the bunch will increase and the clamp member 410 is required to move away from the upper transport belt 312 to accommodate for this change in thickness in order to apply a predetermined clamping force on the bunch 350.

Figure 7:
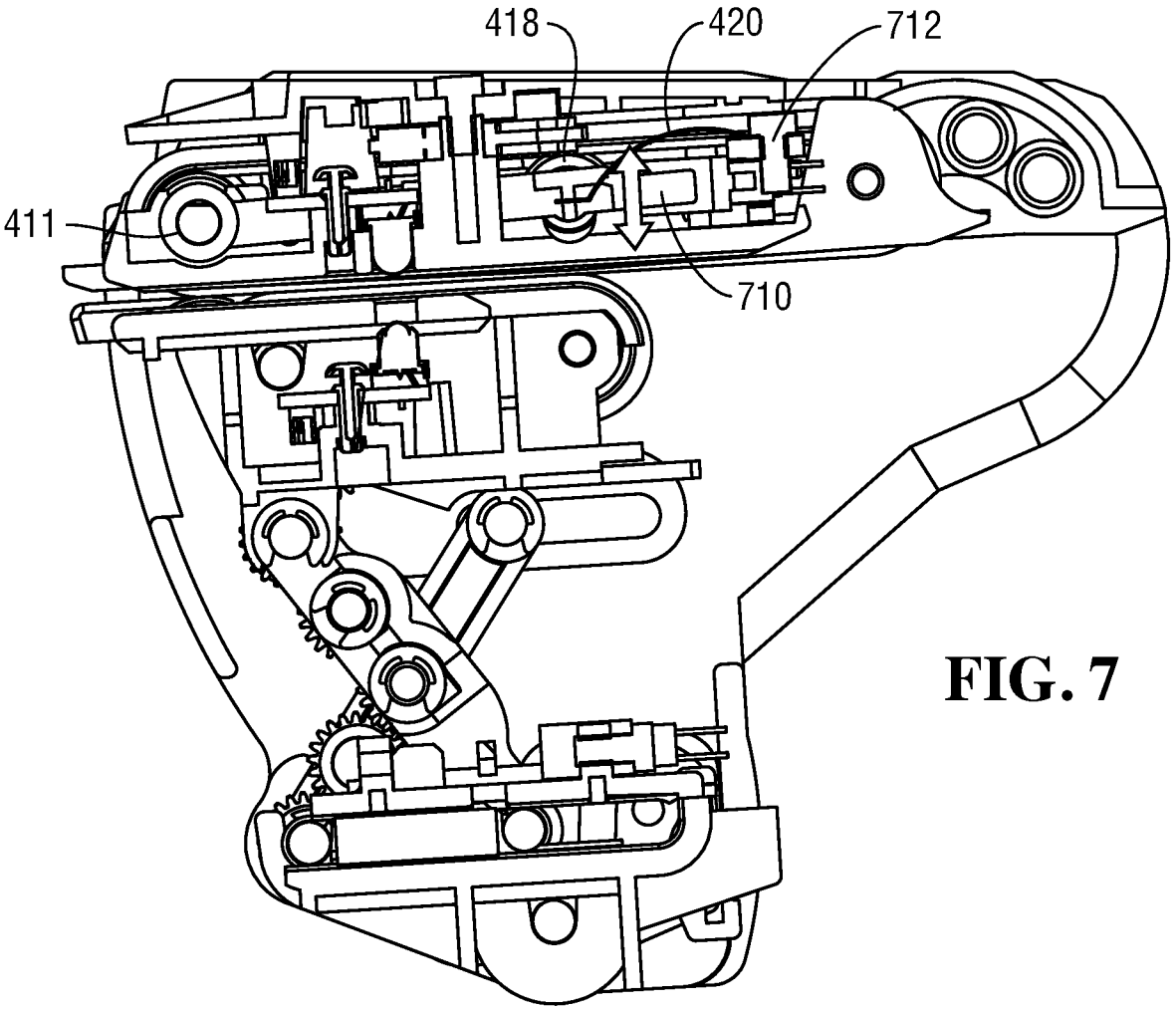
FIG. 7 illustrates a displacement sensor of the clamping mechanism of FIGS. 4 to 6.

As shown in FIG. 7, a flag arm 710 is attached to a shaft 419 of the idler roller 418 to thereby move with the idler roller 418 by a distance responsive to a thickness of the bunch of media items 350. The flag arm 710 blocks an optical interrupt sensor 712 by an amount which is dependent on the displacement of the flag arm 710. The sensor 712 sends a signal to a controller (not shown) of the ATM and the clamp member 410 (and lower transport belt 310) is moved towards or away from the upper transport belt 312 responsive to the displacement of the idler roller 418 and a thickness of the bunch 350. The flag arm 710 and sensor 712 arrangement effectively provides a feedback loop by automatically adjusting the position of the clamp member 410 relative to the upper transport belt 312 to apply a predetermined clamp force to the bunch of media items 350 responsive to a thickness of the bunch 350.

Figure 8:
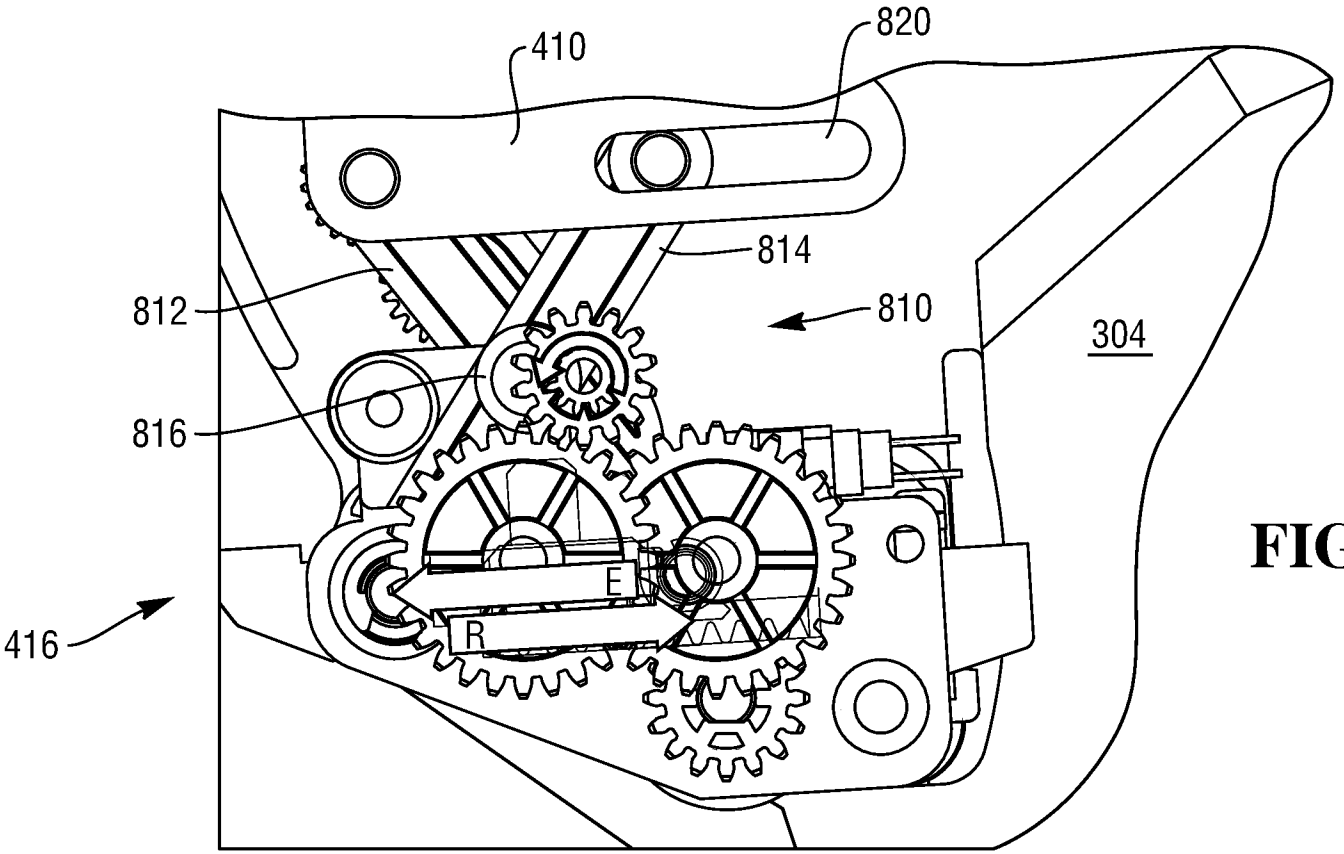
FIG. 8 illustrates an actuator mechanism of the clamping mechanism of FIGS. 4 to 7 for adjusting a clamp force applied to a bunch of media items by the clamping mechanism.

As shown best in FIG. 8, the clamp member 410 of the clamping mechanism 380 is moved towards or away from the upper transport belt 312 by a stepper motor (not shown) which is coupled to the clamp member 410 by a scissor mechanism 810. The scissor mechanism 810 includes a pair of elongate scissor members 812, 814 which are pivotally attached at respective central portions by a pivot member 816. An upper end of the first scissor member 812 is pivotally attached to the clamp member 410 and an upper end of the second scissor member 814 is slideably coupled to the clamp member 410 via a slot 820 of the clamp member 410. In a similar manner, a lower end of the first scissor member 812 is slideably supported in a slot (not shown) of the lower transport member 304 of the second pair of transport members 304, 305 and a lower end of the second scissor member 814 is pivotally attached to the lower transport member 304 of the pair of second transport members 304, 305.

The lower end of the first scissor 812 is urged towards the lower end of the second scissor member 814 (as indicated by arrow E) by an extension spring (not shown) to bias the clamp member 410 upwardly towards an extended position (as shown in FIG. 5). The stepper motor overcomes a force exerted by the extension spring to move the lower end of the first scissor member 812 away from the lower end of the second scissor member 814 (as indicated by arrow R) and move the clamp member 410 downwardly towards a retracted position (as shown in FIG. 4). The stepper motor is coupled to the lower end of the first scissor member 812 by a rack and pinion arrangement (not shown).

The clamping mechanism 380 according to certain embodiments of the present invention therefore automatically moves a clamp member 410 supporting a lower transport belt 310 towards or away from an upper transport belt 312 responsive to a change in thickness of a bunch of media items 350 located between the upper and lower transport belts 310, 312 to thereby ensure a predetermined clamp force applied to the bunch 350 by the clamp member 410 is constant for effectively removing or adding media items from or to the bunch 350. The clamping mechanism 380 according to certain embodiments of the present invention allows a predetermined clamp force to be applied to a bunch of media items 350 for effectively transporting the bunch along a predetermined transport path 202, 204. For example, when a bunch of media items 350 is to be transported along a predetermined transport path 202, 204, a first predetermined clamp force is applied to the bunch 350 by the clamping mechanism 380. Alternatively, when media items are to be removed or added to a bunch of media items 350, a second predetermined clamp force may be applied to the bunch to allow for effective addition or removal of media items from the bunch. Aptly, the second clamp force is less than the first clamping force to enable much greater performance and efficiency for document separation and a lower fault rate. A higher first clamp force for document transportation also prevents the bunch from becoming damaged or skewed when being transported and effectively grips the bunch of media items to be transported along the predetermined transport path without the internal media items of the bunch shifting.

The clamping mechanism 380 according to certain embodiments of the present invention provides a form of force feedback detect on a bunch of media items to automatically control a clamp force applied to the bunch by the clamping mechanism. The clamp member 410 is free to compress or move downwardly against the extension spring whilst a compression on the bunch can be measured by the optical sensor which is at least partially blocked by the flag arm responsive to a displacement of the idler roller which itself urges the upper transport belt against the bunch. The clamping mechanism according to certain embodiments of the present invention thereby allows the bunch to be compressed to a controlled light compression force during the infeed mode of operation, whilst also allowing the extension spring of the clamping mechanism to apply a larger compression force on the bunch during a transport mode of operation.

The clamping mechanism according to certain embodiments of the present invention is space conservative, stable, simple, low cost and accurate. The sensor flag may be incorporated into the existing drive system of the upper transport member 305 of the second pair of transport members 304, 305 of the transport mechanism 300 which enables accurate compression feedback for any form of bunch. The optical sensor requires no calibration and is repeatable on different media item processing modules.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of transporting at least one media item along a transport path, comprising:

locating a bunch of media items between at least one support surface and at least one clamp member; and selectively moving said clamp member towards in an upward direction or away from said support surface in a downward and a retracted position to apply a first predetermined clamp force to the bunch of media items during transport of the bunch to or from an infeed aperture, wherein the first predetermined clamp force is dependent on a thickness of the bunch, wherein said support surface includes an upper transport belt that transports the bunch of media items and remains in a fixed position relative to the moving of said clamp member, wherein the upper transport belt is situated above the bunch of media items and remains in the fixed position and the clamp member is situated below the bunch of media items and moves toward the upper transport belt to apply force and away from the upper transport belt to release force, wherein selectively moving further includes activating a stepper motor that moves a lower end of a first scissor member away from a lower end of a second scissor member through a sliding movement within slots integrated into the clamp member, wherein a first end of the first scissor member slides within a first slot of the clamp member and a first end of the second scissor member slides within a second slot of the clamp member, wherein a second end of the first scissor member is fixedly attached to a first end of the clamp member and a second end of the second scissor member is fixedly attached to a second end of the clamp member, wherein the first and second scissor members are part of said clamp member, and wherein the lower end of the first scissor member is biased towards the lower end of the second scissor member upwardly towards an extended position when the stepper motor is activated for moving the clamp member into the retracted position, and wherein an upper end of the first scissor member is slideably coupled to the clamp member via the slots, and the lower end of the second scissor member is slideably supported via the slots, and wherein;

sensing, by an optical sensor, a displacement of a moveable element towards or away from the clamp member by a flag arm blocking the optical sensor by an amount that is dependent on the displacement of the flag arm and moving the clamp member and a lower transport belt towards or away from the upper transport belt responsive to the displacement;

selectively moving said clamp member towards in the upward direction or away in the downward direction and the retracted position from said support surface to apply a second predetermined clamp force to the bunch of media items when at least one media item is to be removed from or added to the bunch by a feeder/separator module, wherein the second predetermined clamp force is dependent on changes to the thickness of the bunch; and selectively rotating a first set of rollers that support the upper transport belt in an infeed direction or a return direction while selectively rotating a second set of rollers that support the lower transport belt in the infeed direction or the return direction to transport the bunch of media items.

2. The method as claimed in claim 1, further comprising:

determining the thickness associated with the bunch of media items; and selectively moving said clamp member towards or away from said support surface responsive to the thickness.

3. The method as claimed in claim 2, further comprising:

removing or adding a media item from or to the bunch of media items to respectively decrease or increase said thickness of the bunch of media items and moving the clamp member to maintain a pre-determined clamp force as the thickness is decreased or increased.

4. The method as claimed in claim 2, further comprising:

determining said thickness of the bunch of media items by the amount that reflects changes in said thickness of the bunch of media items; and selectively moving the clamp member towards or away from the support surface to apply the predetermined clamp force to the bunch of media items responsive to the displacement of the moveable element.

5. The method as claimed in claim 4, further comprising:

biasing said moveable element towards said clamp member.

6. Apparatus for transporting at least one media item along a transport path, comprising:

at least one clamp member to apply a first clamp force to a bunch of media items located between a support surface and said clamp member during transport of the bunch to or from an infeed aperture and to apply a second clamp force to said bunch of media items when at least one media item is to be removed from or added to the bunch;

wherein said clamp member is selectively moveable towards in an upward direction or away from said support surface in a downward and a retracted position to apply a predetermined clamp force to the bunch of media items, wherein the first clamp force is dependent on a thickness for the bunch and the predetermined clamp force is dependent on changes to the thickness of the bunch, wherein said support surface includes an upper transport belt that transports the bunch of media items and remains in a fixed position relative to the moving of said clamp member, wherein the upper transport belt is situated above the bunch and remains in the fixed position and the clamp member is situated below the bunch of media items and moves toward the upper transport belt to apply force and away from the upper transport belt to release force;

wherein said clamp member further includes a pair of elongated scissor members pivotally attached at respective central portions by a pivot member, the pair of elongated scissor members include a first scissor member and a second scissor member, wherein an upper end of the first scissor member is pivotally attached to the clamp member, an upper end of the second scissor member is slideably coupled via slots integrated into the clamp member, a lower end of the first scissor member is slideably supported within the slots of the clamp member, and a lower end of the second scissor member is pivotally attached to the lower transport member and a second transport member, and wherein the lower end of the first scissor member is urged towards the lower end of the second scissor member by a spring to bias said clamp member upwardly towards an extended position using the slots and sliding the lower end of the second scissor member towards the lower end of the second scissor member within a first slot of the clamp member, a stepper motor slideably moves the lower end of the first scissor member away from the lower end of the second scissor member within the slots to move said clamp member into the retracted position;

an optical sensor to sense a displacement of a moveable element towards or away from the clamp member; and a flag arm to block the optical sensor by an amount that is dependent of the displacement of the flag arm;

wherein the claim member and a lower transport belt are configured to move towards or away from the upper transport belt relative to the displacement determined by the optical sensor and the flag arm wherein a first set of rollers that support the upper transport belt is selectively rotated in an infeed direction or a return direction and a second set of rollers that support the lower transport belt is selectively rotated in the infeed direction or the return direction to transport the bunch of media items.

7. The apparatus as claimed in claim 6, further comprising:

the moveable element moveable towards or away from said clamp member responsive to a change in the thickness associated with the bunch of media items, wherein said clamp member is selectively moved towards or away from said support surface responsive to said thickness.

8. The apparatus as claimed in claim 7, further comprising:

at least one target element associated with the moveable element;

wherein the optical sensor comprises an optical displacement sensor that determines a location of said target element responsive to said displacement of the moveable element.

9. The apparatus as claimed in claim 6, further comprising:

at least one transport belt for locating the bunch of media items, wherein an outer drive surface of said transport belt further comprises said support surface.

10. The apparatus as claimed in claim 9, wherein said moveable element is biased against the upper transport belt of said transport belt and is moveable towards or away from said clamp member responsive to a displacement of the transport belt during the change in the thickness.

11. The apparatus as claimed in claim 10, wherein said moveable element comprises at least one transport belt roller.

12. The apparatus as claimed in claim 6, further comprising:

a biasing member that constantly biases the clamp member towards the support surface; and an actuator that selectively locates a portion of the clamp member to at least partially counteract the constant biasing to selectively move the clamp member at least partially away from the support surface.

13. A media item processing module comprising the apparatus as claimed in claim 6.

14. A method of locating at least one media item, comprising:

clamping a bunch of media items between a clamp member and a support surface, wherein a clamp force applied by the clamp member during transport of said bunch based on a thickness for the bunch is greater than a clamp force applied by the clamp member based on a change in the thickness when at least one media item is to be removed from or added to the bunch, and wherein the clamp force is dependent upon a current thickness for the bunch, and wherein said support surface includes an upper transport belt that transports the bunch of media items and remains in a fixed position relative to the moving of said clamp member, wherein clamping further includes moving said clamp member in an upward direction towards the upper transport belt for applying the clamp force and moving said clamp member in a downward direction in a retracted position to release the clamp force, wherein the upper transport belt is situated above the bunch of media items and remains in the fixed position and the clamp member is situated below the bunch of media items and moves toward the upper transport belt to apply force and away from the upper transport belt to release force, wherein clamping further includes activating a stepper motor that moves a lower end of a first scissor member away from a lower end of a second scissor member, wherein the first and second scissor members are part of the clamp member, and wherein the lower end of the first scissor member is biased towards the lower end of the second scissor member upwardly towards an extended position when the stepper motor is activated for moving the clamp member into the retracted position, and wherein an upper end of the first scissor member is pivotally attached to the clamp member, an upper end of the second scissor member is slideably coupled via slots integrated into the clamp member, the lower end of the first scissor member is slideably supported within the slots of the clamp member, and the lower end of the second scissor member is pivotally attached to the lower transport member and a second transport member;

determining a thickness of the bunch by sensing, using an optical sensor, a displacement of a moveable element when a flag arm blocks the optical sensor by an amount that is dependent on the displacement of the flag arm;

moving the clamp member and a lower transport belt towards or away from the upper transport belt responsive to the displacement by sliding the first scissor member and the second scissor member within the slots of the clamp member; and selectively rotating a first set of rollers that support the upper transport belt in an infeed direction or a return direction while selectively rotating a second set of rollers that support the lower transport belt in the infeed direction or the return direction to transport the bunch of media items.

* * * * *